US005211417A

United States Patent [19]

Klaus et al.

[11] Patent Number: 5,211,417

[45] Date of Patent: May 18, 1993

[54] SKI BINDING

[75] Inventors: Holzl Klaus, Vienna; Erdei Roland, Weigelsdorf; Janisch Andreas, Tribuswinkel; Wladar Helmut, Vienna; Wurthner Hubert, Hainburg/D.; Hatvan Hans, Vienna; Damborsky Klaus, Klosterneuburg/Kierling, all of Austria

[73] Assignee: HTM Sport-und Freizeitgerate GmbH, Austria

[21] Appl. No.: 721,834

[22] Filed: Jun. 26, 1991

Related U.S. Application Data

[62] Division of Ser. No. 411,537, Oct. 3, 1989, Pat. No. 5,056,808.

[30] Foreign Application Priority Data

Feb. 19, 1988 [AT] Austria ..... 394/88
Jul. 15, 1988 [AT] Austria ..... 1820/88
Sep. 30, 1988 [AT] Austria ..... 2411/88

[51] Int. Cl.[5] ..... A63C 9/00

[52] U.S. Cl. ..... 280/617; 280/633; 280/636

[58] Field of Search ..... 280/616, 617, 618, 636, 280/633, 605, 607

[56] References Cited

U.S. PATENT DOCUMENTS 3,790,186 2/1974 Kanno ..... 280/617
3,797,844 3/1974 Smolka et al. ..... 280/617
3,937,481 2/1976 Koleda ..... 280/617
3,977,688 8/1976 Imagawa ..... 280/607
4,522,422 6/1985 Jaeger ..... 280/617
4,896,895 1/1990 Bettosini ..... 280/618
5,056,808 10/1991 Holzl et al. ..... 280/617

FOREIGN PATENT DOCUMENTS 1905217 8/1970 Fed. Rep. of Germany ..... 280/617
2544211 10/1984 France ..... 280/605

*Primary Examiner*—David M. Mitchell
*Attorney, Agent, or Firm*—Finnegan, Henderson, Farabow, Garrett & Dunner

[57] ABSTRACT

This ski binding has a toe-holding unit, a heel holder and a connecting element, which extends in the longitudinal direction of the ski between the toe-holding unit and the heel holder, the heel holder being arranged at the rear end of the connecting element and guided slidingly movably in a guide rail fixed to the ski and, in the mounted state of the ski binding, the toe-holding unit being fastened directly by its support member on the upper side of the ski. With such a ski binding, in order to make an unhindered flexure of the ski possible when negotiating moguls in the case of all shoe sizes, the invention provides that the connecting element (3) extends without any guidance between the toe-holding unit (4) and the heel holder (5), that the toe-holding unit (4) has a locking element (8), at which the connecting element (3) can be fixed in the longitudinal direction of the ski by means of a receptacle (9) and that the heel holder (5) can be adjusted and fixed relative to the connecting element (3) in the longitudinal direction of the ski.

36 Claims, 14 Drawing Sheets

SKI BINDING

This is a division of application Ser. No. 07/411,537, filed Oct. 3, 1989, now U.S. Pat. No. 5,056,808.

BACKGROUND OF THE INVENTION

1. Field of the Invention

The invention relates to ski bindings.

2. Description of the Related Art

A related art ski binding is claimed in German Offenlegungsschrift 1,478,106 (see FIG. 2) (cf. also the brochure dating from 1965/66). In the case of this ski binding, the plate bearing the toe-holding unit causes a stiffening of the ski in the region underneath the ski binding which, in particular in the case of small shoe sizes, hinders a flexure of the ski when negotiating moguls.

In the case of the ski binding according to U.S. Pat. No. 3,937,481, a metal band is displaceably mounted on the ski and secured against any lifting off from the ski. The metal band bears a toe-holding unit and a heel holder, the latter being adjustable with respect to the metal band for adaptation to various shoe sizes. The metal band itself is guided with respect to the ski in the longitudinal direction of the latter by a screw engaging in a slot and two lateral claws. At the front end of the metal band, a type of toothed rack is cut in, with which a worm meshes, which is accommodated in a housing fixed to the ski and is loaded by a compression spring. This ski binding has the purpose on the one hand of making possible a flexure of the ski when negotiating moguls and on the other hand of absorbing any shock exerted on the skier which arises when the ski hits an obstacle. The production of this ski binding entails difficulties.

Finally, U.S. Pat. No. 3,314,687 describes a ski binding in which a continuous profiled guide rail underneath the toe-holding unit and the heel holder is fastened on the ski. However, this guide rail causes such a stiffening of the ski in the region underneath the ski binding that a flexure of the ski in this region . . . (lacuna) virtually ruled out when negotiating a mogul.

SUMMARY OF THE INVENTION

An object of the invention is to eliminate the disadvantages of the known bindings and specifying two solutions which make an unhindered flexure of the ski possible with all shoe sizes.

As will later be discussed in detail, this object is by the combination of three features which makes a simple structure of the ski binding possible.

Of these three features, the second is admittedly known in essence from German Offenlegungsschrift 3,109,754. However, in the case of the design described, it is disadvantageous that the toe-holding unit is not fastened directly on the ski but can be fixed in various positions via a guide rail, in which a row of holes are made. A locking screw is provided for this purpose. The metal band extends above the guide rail, so that, to adjust the toe-holding unit relative to the metal band, the locking screw has to be loosened and the entire toe-holding unit together with metal band has to be pushed out of the guide rail.

As far as the third feature is concerned, this can be taken from U.S. Pat. No. 3,937,481, cited at the beginning. Here too, as already mentioned, the heel holder can be adjusted and fixed in various positions relative to the metal band in the longitudinal direction of the ski.

By means of the metal band, toe-holding unit and heel holder can be adjusted jointly relative to the ski for different styles of skiing.

A further design, in which the toe holder is adjustable relative to the metal band, can be taken from FIGS. 3 and 4 of German Offenlegungsschrift 2,222,161. In the case of this design, the metal band is connected fixedly to the base plates of toe-holding unit and heel holder. The heel holder is not, however, arranged on the metal band and is also not guided slidingly movably in its guide rail. As a result, however, the desired elasticity of the ski with mounted ski binding is not achieved.

The present invention has the advantage that virtually all of the design elements already exist in the case of commercially available toe-holding units and that only the one element, namely the bearing member, has to be provided with a projection.

In comparison with the known design, in which the connecting element is led between the toe-holding unit and the heel holder underneath a slide plate fastened to the ski and in which the toe-holding unit has to be pulled out of the guide for adjustment, the solution according to the invention has the additional advantage that the setting of the toe-holding unit to different shoe sizes can be performed very easily without pulling-out of the toe-holding unit.

The features of the present invention make a reliable shielding of the connecting element against moisture and dirt possible in the case of all ski boot sizes. In comparison with a product on the market, which is described for example in the ESS-VAR catalog 87, the features of the invention have the advantage that no individual adaptation of the cover to different ski boot sizes is necessary. As a result, however, there is no need for the cutting-off of individual regions in the case of small ski boots and a change of the cover if the same binding is to be converted from relatively small ski boots to larger ski boots. Furthermore, the connecting element, designed as a metal band, can also be produced from a stainless steel.

The subject of the invention ensures, in a particularly simple way in terms of design, the adaptation of the connecting element to different sizes of ski boots.

The features of the invention specify a particularly favorable and simple solution for the practical design of the locking mechanism.

The solution specified in accordance with the invention has the advantage that the connecting element can be adjusted infinitely variably with respect to the guide rail for the toe-holding unit. In this case, the design of the invention has proved particularly advantageous, especially as no additional elements have to be used for this adjustment.

The subject of the invention also makes possible, in a simple way, a reliable guidance of the connecting element in the region of the heel holder.

further, the invention has the effect that the production of the locking element for the adjustable heel holder can be performed in a particularly simple way irrespective of the choice of material for the connecting element. In addition, this measure makes possible the use of a greater material thickness for the attachment receiving the locking teeth than would be possible in the case of the connecting element for reasons of its flexibility.

Additionally, the invention has the effect that the end regions of the connecting element exposed from the encasing are also protected. Furthermore, the mounting and demounting of the ski binding is facilitated. The invention also aims in this direction in a design-related way.

The feature of the invention ensure a simple locking of tread plate and cover.

The invention also has the advantage that any mistaken placement of a hole with circular cross-section onto the square projection is ruled out.

Although the range of adjustment of the heel holder with respect to the connecting element makes possible an adaptation of the ski binding to various sizes of ski boots to a predetermined extent, the invention increases this range of adjustment.

Further, the invention makes possible a multiple use of the same connecting element, since the latter can also be used without any alteration in conjunction with a toe-holding unit or with a guide rail of a toe-holding unit.

The invention has the effect on the one hand that material is saved and on the other hand that there is slightly better compensation for the upward curving of the ski caused by the two clamping units (toe-holding unit and heel holder) by shifting of the rear point of application of the shoe sole toward the center of the binding. As a result, the pressure distribution on the ski is also improved.

The invention brings with it the advantage that the friction between the ski boot and the pedal is reduced and also has the effect that the transfer of pressure from the pedal to the ski takes place via the front sides of the projections, that is over a surface area and not linearly as in the case of a roller.

If a connecting element with an encasing is used, measures of the invention can be applied with particular advantage.

In addition, the invention has the effect that the connecting element itself is used for the transfer of pressure. The arrangement, if any, of at least one rest makes a height compensation possible and brings about a reduction in the wear of the connecting element.

The invention has the effect absorbing shocks acting on the skier, and also brings with it the advantage that the elastic layer cannot be damaged by the ski boot.

Further, the invention make a particularly simple production of the elastic layer possible and also has the effect of saving material.

The invention makes a subsequent application of the elastic layer on an already existing ski binding possible and makes it possible to adapt the elastic layer to the weight of the skier and his style of skiing.

The invention has the effect that any unintentional releasing of the encasing from the connecting element is reliably hindered and makes it possible for the elastic layer to rest flatly on the underside of the connecting element, a satisfactory connection with the encasing being established in spite of this.

Further, the features of the invention have the effect of allowing a ski brake to also be used without a connecting element.

BRIEF DESCRIPTION OF THE DRAWINGS

Embodiments of the subject of the invention are represented by way of example in the drawing.

DESCRIPTION OF THE PREFERRED EMBODIMENTS

Figure 1:
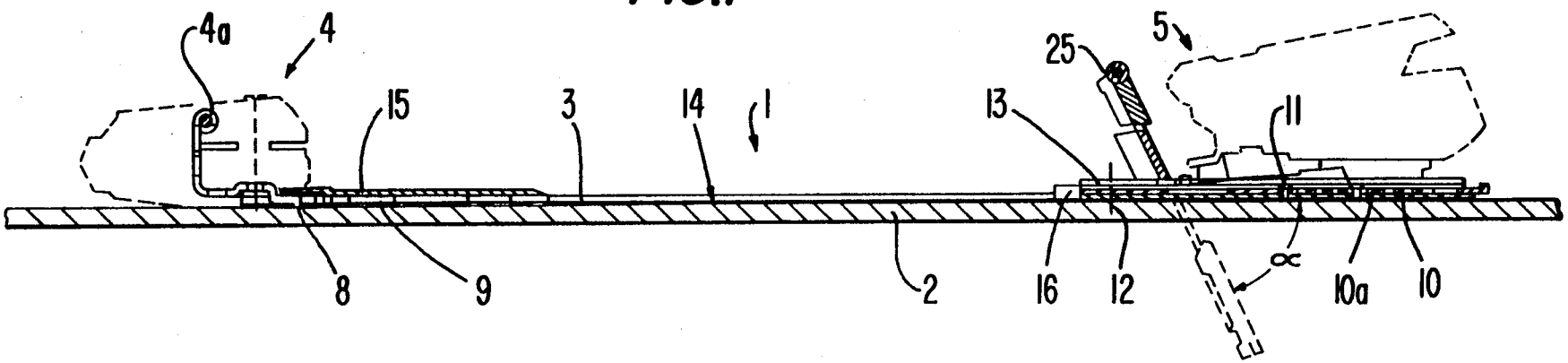
FIG. 1 is a vertical longitudinal center section through a first embodiment of a ski binding of the present invention, illustrating a ski brake, a toe-holding unit and a heel holder and in which the cover is removed.
Figure 2:
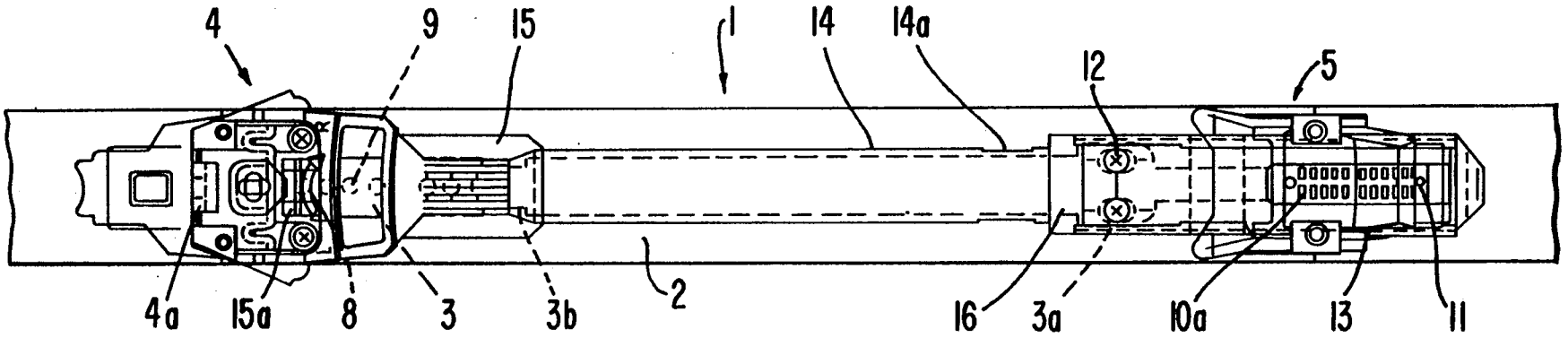
FIG. 2 is a plan view of FIG. 1 with the removed ski brake.

In FIGS. 1 and 2, the ski binding is denoted as a whole by 1. This is fastened on a ski 2. The ski binding 1 comprises a connecting element 3, in the form of a metal band, a toe-holding unit 4, which is connected to the metal band 3 in a way still to be described in more detail, a heel holder 5, which is guided in a guide rail 13 fixed to the ski and can be locked in various positions with the metal band 3, as well as a ski brake 25.

Figure 3:
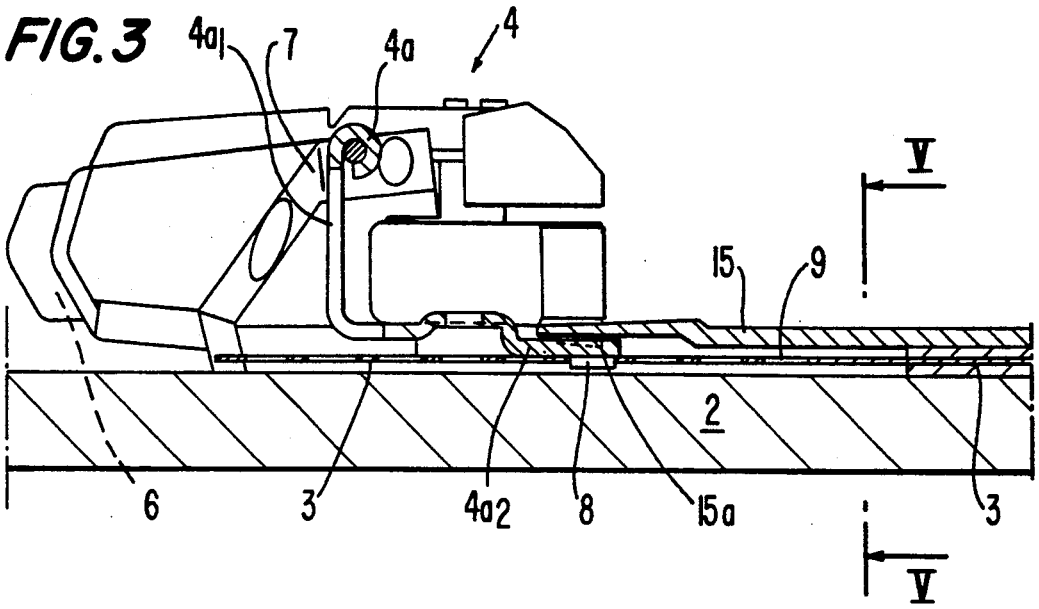
FIG. 3 is a detailed vertical longitudinal center section of the ski binding of FIG. 1.
Figure 4:
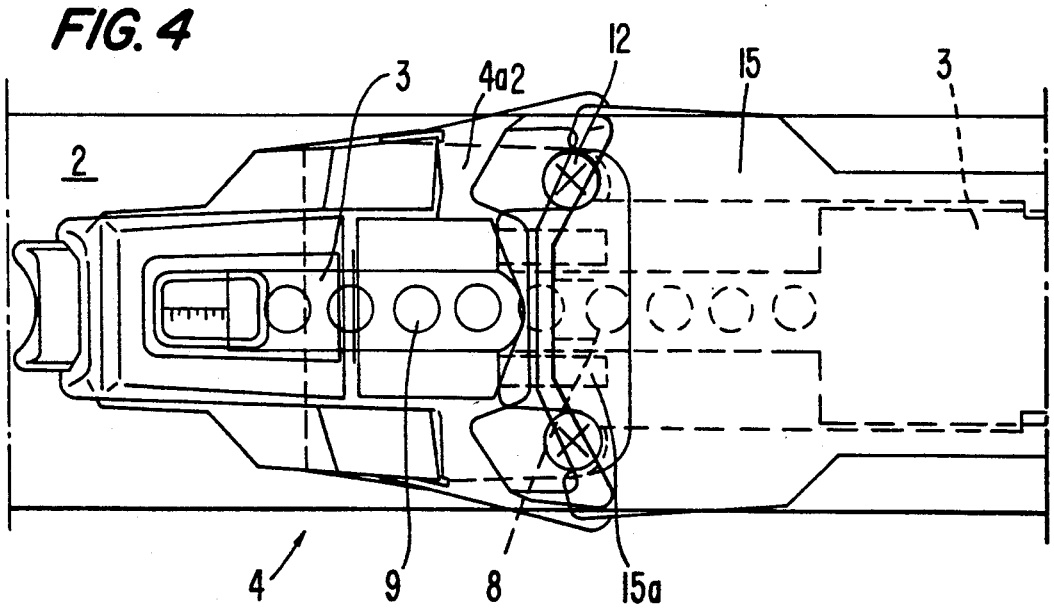
FIG. 4 is an associated plan view of FIG. 3.

An angular supporting member 4*a*, the one leg $4a_1$ of which runs perpendicular to the upper side of the ski and the other leg $4a_2$ of which runs parallel to the upper side of the ski, is arranged in the toe-holding unit 4. As FIG. 4 shows, the leg $4a_2$ is fastened on the ski 2 by means of screws 12. According to FIG. 3, the supporting member 4*a* is connected to a housing 7, which receives a release spring (not shown) in a known way.

The horizontal leg $4a_2$ bears a downwardly protruding projection 8. The setscrew for the release spring is denoted by 6.

The metal band 3 extends in the longitudinal direction of the ski 2. At its front end, a row of holes 9 is made in the metal band 3. The projection 8 arranged on the leg $4a_2$ of the supporting member 4a is engaged in one of the holes 9 of the row of holes. At the rear end of the metal band 3, on its upper side, an attachment 10 is fastened underneath the heel holder 5 by means of rivets 11. In the attachment 10 two rows of rectangular notches 10a are punched out, into which locking teeth 5b of an adjusting catch 5a of the heel holder 5 engage in a way known per se.

Figure 7:
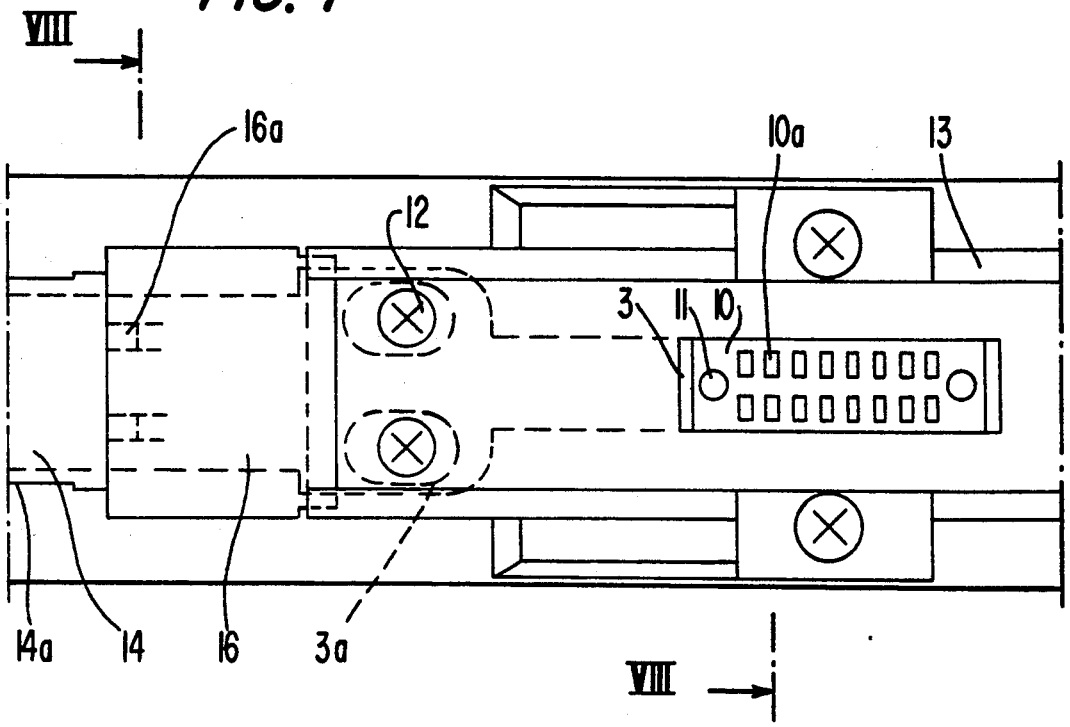
FIG. 7 is an associated plan view of FIG. 6.

The metal band 3 is widened slightly in the region in front of the heel holder 5 (see FIG. 7). In this region, two slots 3a, running in the longitudinal direction of the metal band 3 are made, through which fastening screws 12 pass for the guide rail 13, in which the heel holder 5 is guided.

Figure 5:
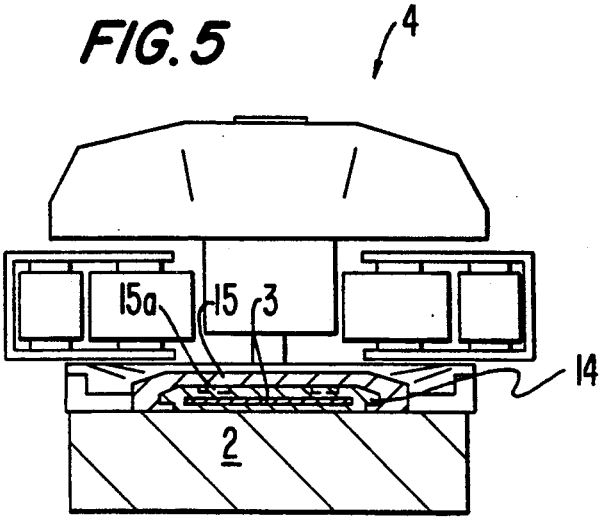
FIG. 5 a sectional view along the line V—V in FIG. 3.
Figure 8:
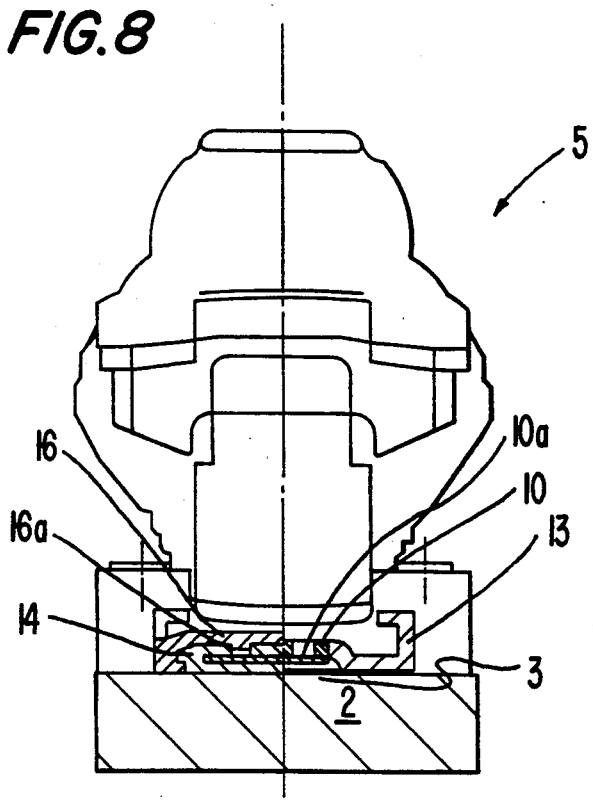
FIG. 8 is a section taken along line VIII—VIII in FIG. 7.

Between the toe-holding unit 4 and the heel holder 5, the metal band 3 is provided with an encasing 14 of a plastic material. In its front region, the metal band 3 is, furthermore, provided with a tread plate 15 and in its rear region it is provided with a cover 16. Tread plate 15 and cover 16 can be displaced in the longitudinal direction of the ski 2. For this reason, the two covering elements 15 and 16 are—seen in cross section—slightly U-shaped, the two legs bearing inwardly directed flanges, which engage underneath the metal band 3 or its encasing 14 (see in particular FIGS. 5 and 8). Two lateral recesses in the metal band 3 are denoted by 3b, which recesses are made after the encasing 14 in the direction of the toe-holding unit 4. Two lateral tapers in the encasing 14 are denoted by 14a, which tapers are provided in the section of the encasing 14 facing the heel holder 5. The lateral recesses 3b of the metal band 3 and the tapers 14a of the encasing 14 serve the purpose of facilitating the fitting and removal of the tread plate 15. The tapers 14a also serve furthermore the purpose of facilitating the mounting and demounting of the cover 16.

Both the tread plate 15 and the cover 16 have a resilient tongue 15a and 16a, respectively, which, in the mounted position, locks the covering element associated with it (15 and 16, respectively) in each case on a part of the ski binding fixed to the ski.

If, for adaptation to different sizes of ski boots, the distance between the toe-holding unit 4 and the heel holder 5 is to be altered, first of all the leg $4a_2$ of the supporting member 4a is unscrewed from the ski 2. Thereafter, the metal band 3 can be separated from the projection 8 and subsequently displaced until the desired distance between toe-holding unit 4 and heel holder 5 is reached. The projection 8 in this case engages in the desired hole 9 of the row of holes. After this displacement, the leg $4a_2$ is screwed fast again. In view of the relatively large distance between the holes 9 of the row of holes, this setting is a coarse setting.

For the fine setting of the distance between the toe-holding unit 4 and the heel holder 5, the adjusting catch 5a of the heel holder 5 is first of all released with respect to the guide rail 13, after which the heel holder 5 in the guide rail 13 is brought into the desired position and locked again in this position. The distance between the notches 10a is dimensioned such that a proper securing of the ski boot (not shown) between toe-holding unit 4 and heel holder 5 is ensured.

Figure 6:
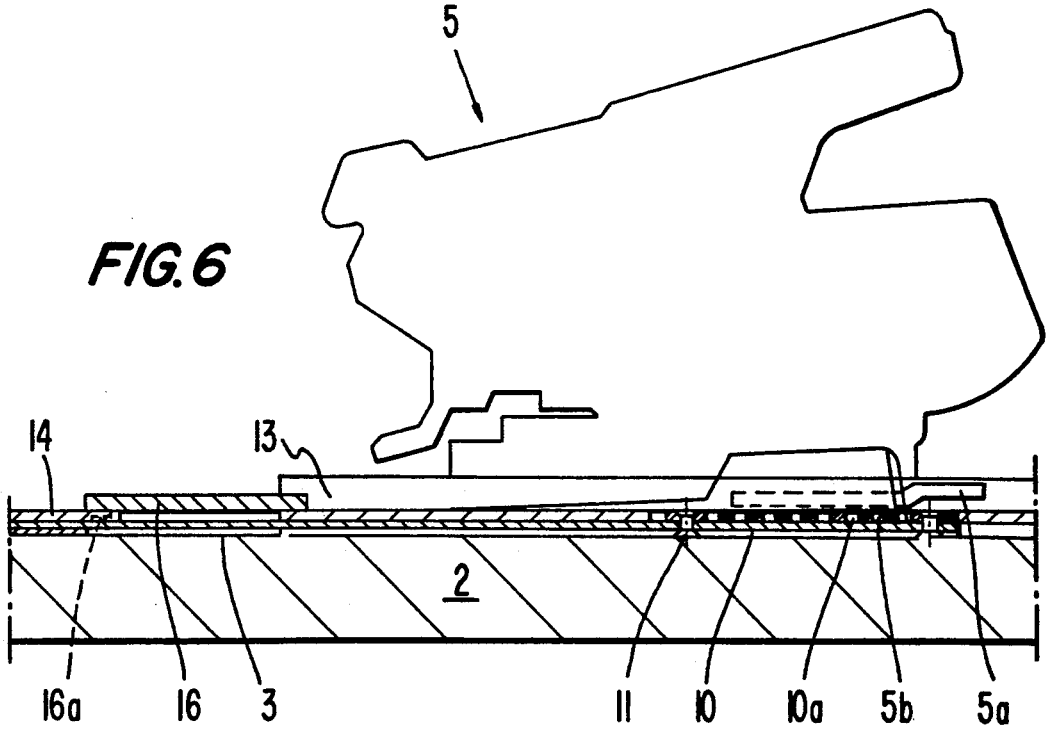
FIG. 6 is a vertical longitudinal center section of the ski binding of FIG. 1.
Figure 9:
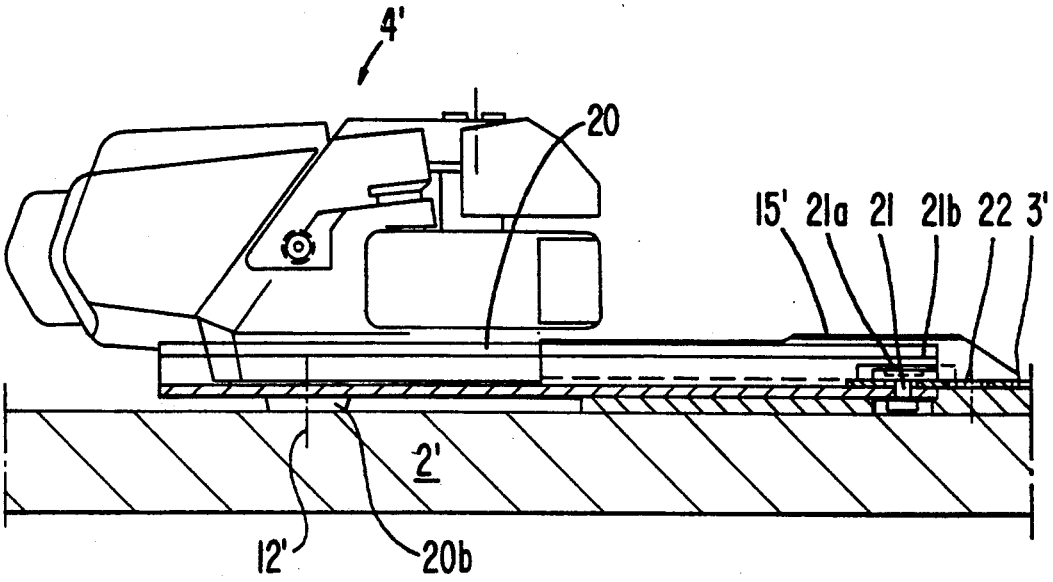
FIGS. 9 and 10 illustrate a second embodiment of a ski binding according to the invention, FIG. 9 being a vertical longitudinal center section and FIG. 10 being a plan view.
Figure 10:
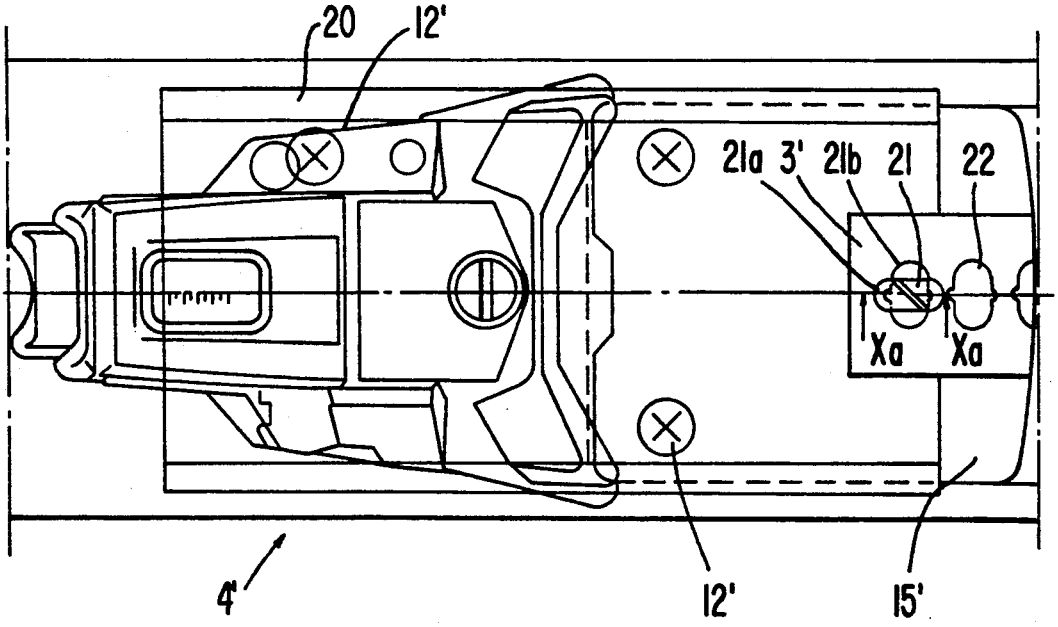
Figure 10A:
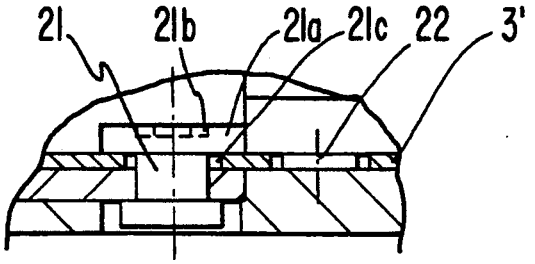
FIG. 10*a* an enlarged sectional view taken along the line Xa—Xa in FIG. 10.
Figure 15B:
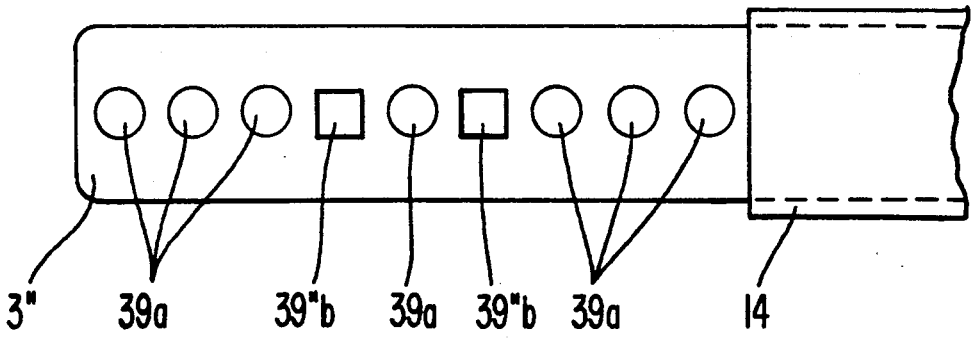
FIG. 15 is an associated view of FIG. 14 from below.
FIG. 15*a* shows a variant of the design of the ski binding illustrated in FIG. 15.

The second embodiment of a ski binding, represented in FIGS. 9–10a, differs from that first described in that the toe-holding unit 4' is not fastened directly to the ski 2', instead a guide rail 20, in which the toe-holding unit 4' can be adjusted, is fastened to the ski 2'. The heel holder (not shown here) corresponds to the design according to FIG. 6. Behind the toe-holding unit 4', the guide rail 20 bears a vertically upwardly protruding, pivotally mounted bolt 21, the head 21a of which is elongate in plan view and provided with a screw slit 21b. In the metal band 3', a plurality of holes 22, elongate in plan view, are punched in its front end, which holes allow the head 21a of the bolt 21 to pass through. In this case, the longitudinal axes of the elongate holes 22 run transversely to the longitudinal axis of the metal band 3'.

The distance of the guide rail 20 from the upper side of the ski 2' is fixed by three feet 20b, which serve the purpose of receiving fastening screws 12'. Of these feet 20b, a pair lies symmetrically to the vertical longitudinal center plane of the guide rail 20. The third foot 20b is offset away from this pair toward the front end of the guide rail 20 and lies together with one foot of this pair in a parallel plane to the vertical longitudinal center plane of the guide rail 20. The locking device for the toe-holding unit 4' is arranged opposite this foot 20b with respect to the vertical longitudinal center plane.

The underside of the head 21a of the bolt 21 is provided with at least one projection 21c, which engages in a recess on the periphery of the hole 22 whenever the longitudinal axis of the head 21a is perpendicular to the longitudinal axis of the hole 22.

If the metal band 3' is to be adjusted with respect to the guide rail 20, first of all the bolt 21 is turned through 90° with the aid of a screwdriver, so that its head 21a aligns with the hole 22. Thereafter, the end region of the metal band 3' can be lifted off from the bolt 21. Then, the metal band 3' is set to the desired distance of the heel holder 5 from the toe-holding unit 4', and after that the chosen hole 22 is placed on the bolt 21. Thereafter, the bolt 21 is once again turned through 90° and held firm in this position by the projection 21c. The engaging action can be further intensified by a cup spring being placed on the bolt 21 under the guide rail 20, which spring attempts to pull the bolt head 21a downward. The entire ski binding can then be set to the desired ski boot size and be mounted on the ski.

Figure 13:
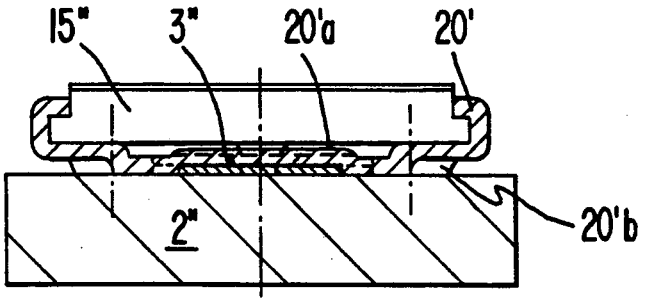
FIGS. 11 to 13 illustrate a third embodiment of the present invention, FIG. 11 being a vertical longitudinal center section, FIG. 12 being a plan view of FIG. 11, and FIG. 13 being a sectional view taken along the line XIII—XIII in FIG. 11.
Figure 11:
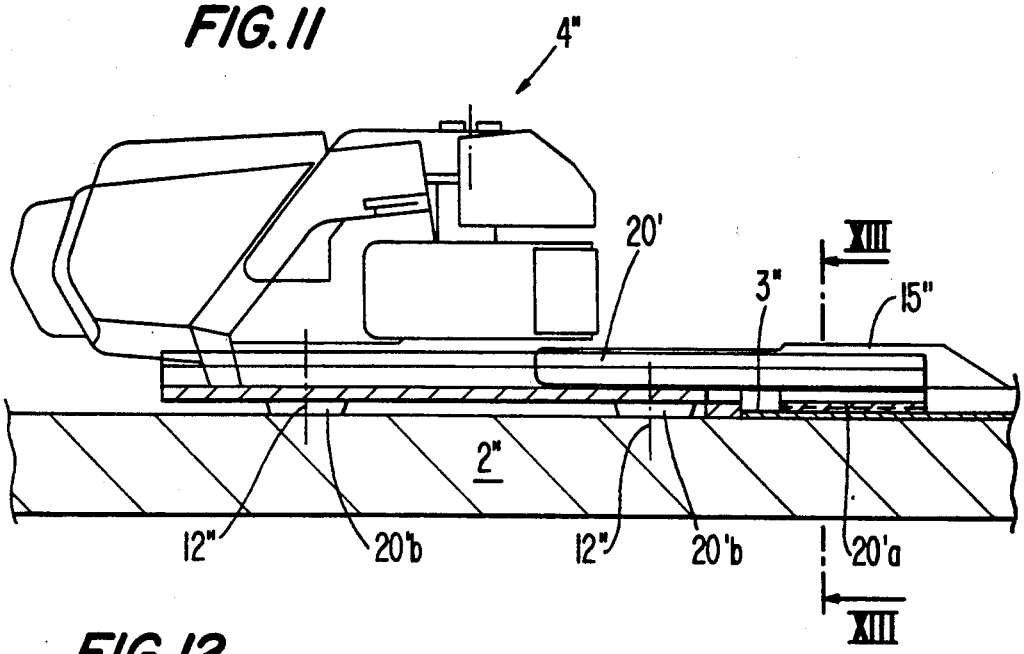
Figure 12:
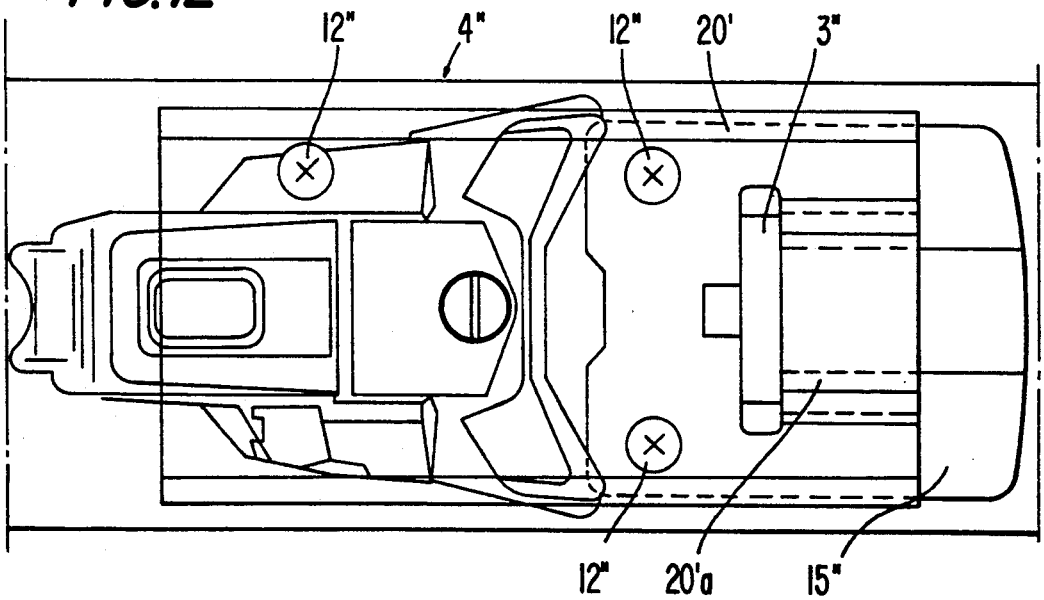

The embodiment of a ski binding according to FIGS. 11–13 differs from that previously described in that the metal band 3'' also rests directly on the upper side of the ski 2'' in the region of the toe-holding unit 4''. At its rear end, the guide rail 20' has an angled-off section 20'a, which presses the metal band 3'' against the ski 2'' when the fastening screws 12'' are tightened. The fastening of the guide rail 20'' is performed as in the case of the exemplary embodiment according to FIGS. 9–10a, namely by three feet 20'b, which serve the purpose of receiving the fastening screws 12'' and of which a pair is arranged on either side of the vertical longitudinal center plane of the guide rail 20'. In this variant, if need be, the metal band 3'' can also be anchored fixedly on or in the guide rail 20'. This development, likewise according to the invention, has the advantage of a faster mounting.

Figure 14:
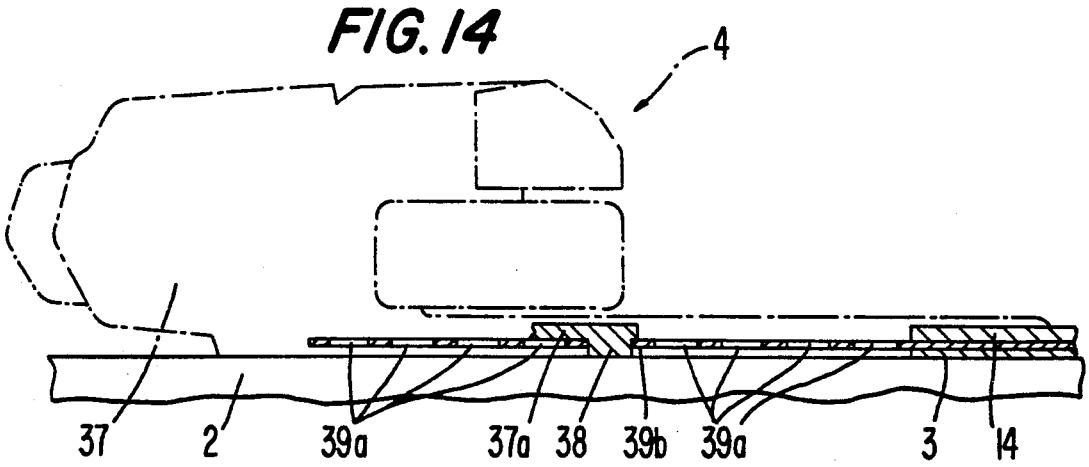
FIG. 14 is a vertical longitudinal center section of a further embodiment according to the first embodiment of the invention.
Figure 15:
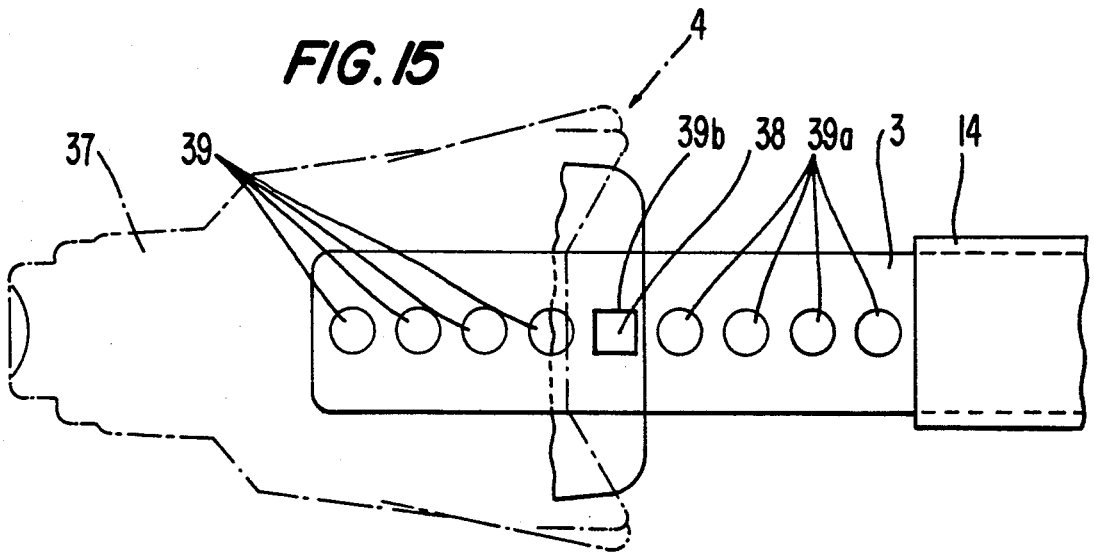

According to FIGS. 14 and 15, the toe-holding unit 4 has a housing 37, which is screwed fast to the ski 2 and which bears at its base 37a a downwardly directed projection 38, designed as a square. As well as circular-cylindrical holes 39*a*, there is also a hole 39*b* with a square cross section in the connecting element 3, at its front end. The projection 38, arranged on the housing 37 of the toe-holding unit 4, engages in this hole 39*b* without any clearance. If, however, the hole 39*b* is provided with a different, unround cross section, for example in the form of a K profile, the projection 38 is adapted to this cross section.

As emerges from FIG. 15, the hole 39*b* with the square cross section is arranged in the central region of the row of holes with the circular-cylindrical holes 39*a*. If the circumference of a circular-cylindrical hole 39*a* is projected onto the square hole 39*b*, the side walls of the latter touch the circumference of the hole 39*a*. As a result, an insertion without any clearance of a cylindrical bolt of another toe-holding unit into the square hole 39*b* is ensured.

Figure 15A:
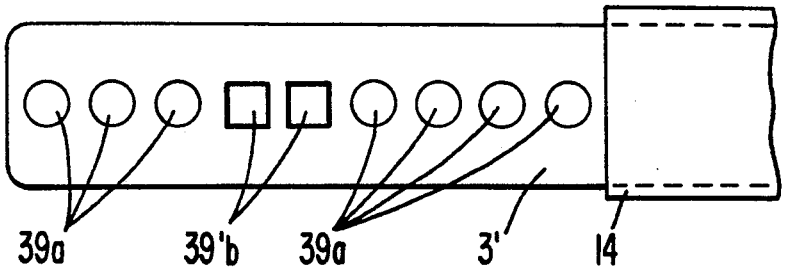

The variant of a connecting element 3' represented in FIG. 15*a* is distinguished by the fact that, instead of a single hole 39*b* according to FIGS. 14 and 15 with a square cross section, two such holes 39'*b* are made in the connecting element 3', which are arranged one behind the other in the longitudinal direction of the ski. As a result, the connecting element 3' can be fixed in two different positions with respect to the toe-holding unit 4. The possibility also exists, however, of arranging both holes with square cross section at a distance from each other, at least one circular-cylindrical hole being located between these holes. In this way, the ski binding can be adapted to different groups of shoe sizes.

Figure 16:
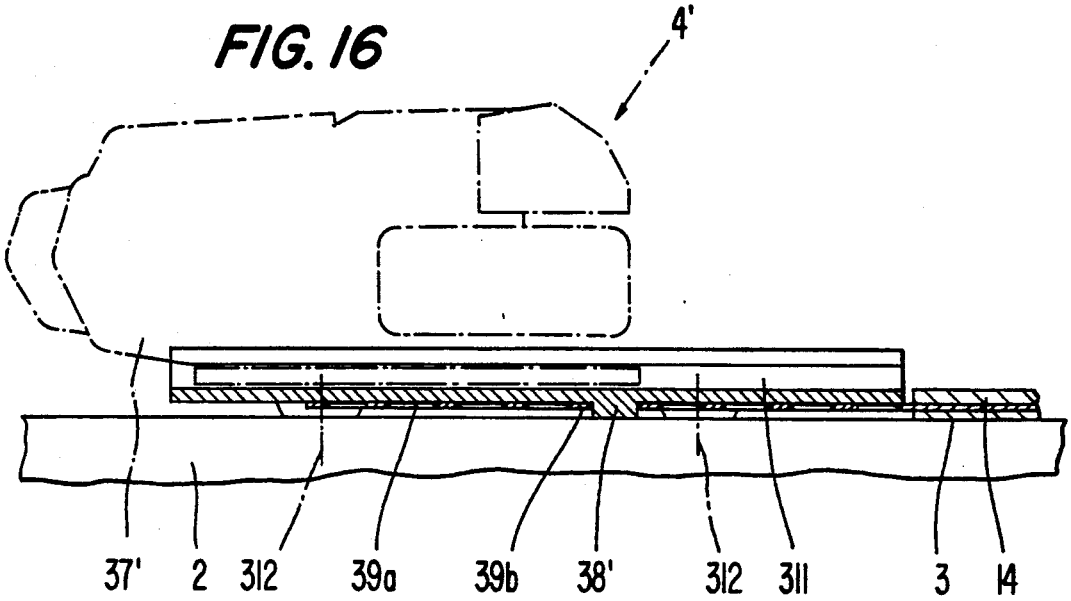
FIG. 16 illustrates a further embodiment having the same connecting element as the design according to FIGS. 14 and 15, the toe-holding unit being modified.
Figure 17:
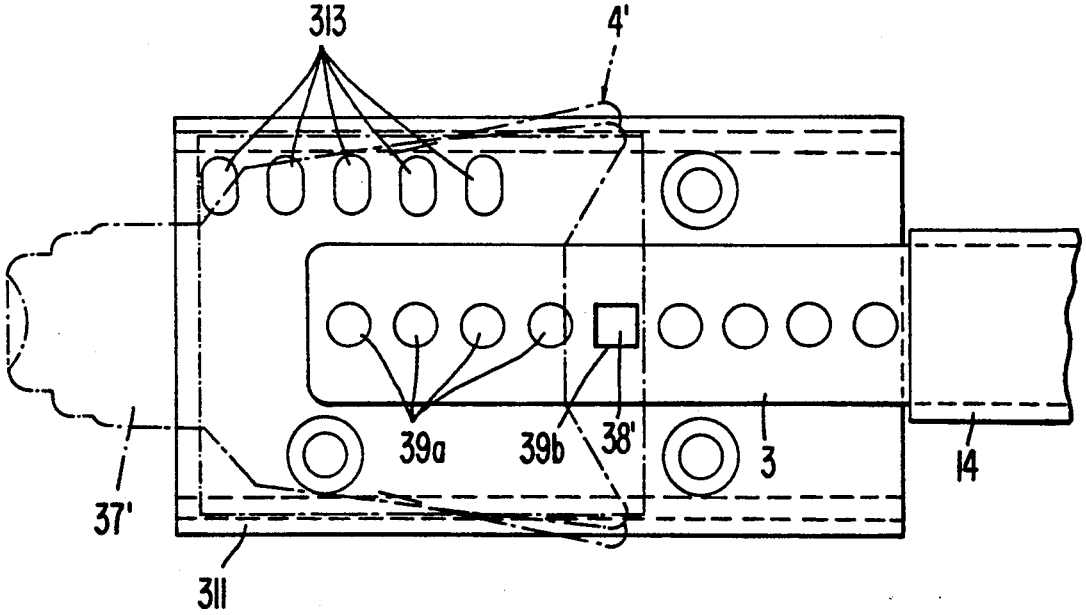
FIG. 17 is a view from below of FIG. 16.

The embodiment of the toe holding unit 4' of a ski binding shown in FIGS. 16 and 17 is distinguished by the fact that its housing 37' is not fixed directly on the upper side of the ski 2, but is mounted adjustably and fixedly in a guide rail 311, which is fastened by screws 312 to the ski 2. For the fixing of the housing 37' on the guide rail 311, the latter has—viewed in the longitudinal direction of the ski—recesses 313 arranged at intervals from one another, in which recesses a locking bolt (not shown) of the housing 37' can be inserted according to choice in a known way. The guide rail 311 is provided with a downwardly directed projection 38' with a square cross section, which can be inserted in the hole 39*b* with square cross section of the row of holes of the connecting element 3 according to FIGS. 14 and 15. It is also possible to use the connecting element 3' according to FIG. 15*a* in the case of a ski binding according to FIGS. 16 and 17.

Figure 18:
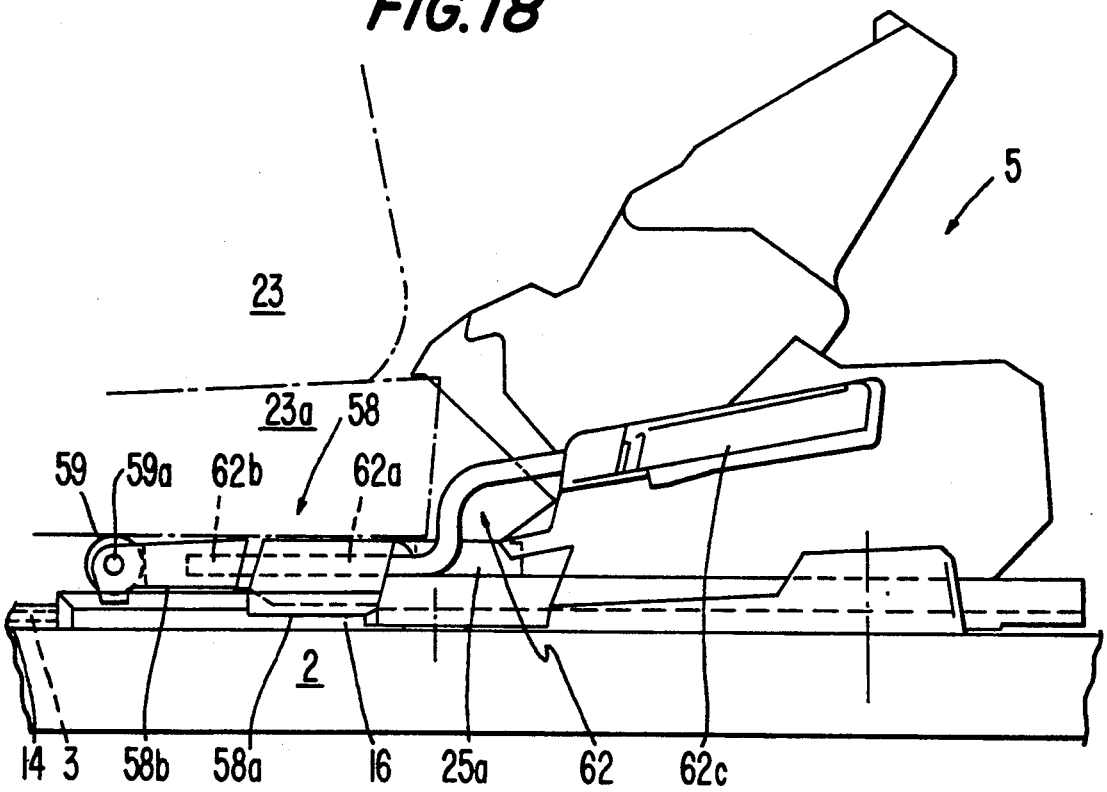
FIG. 18 is a side view of the heel holder region of the ski binding with ski brake in the running position.
Figure 19:
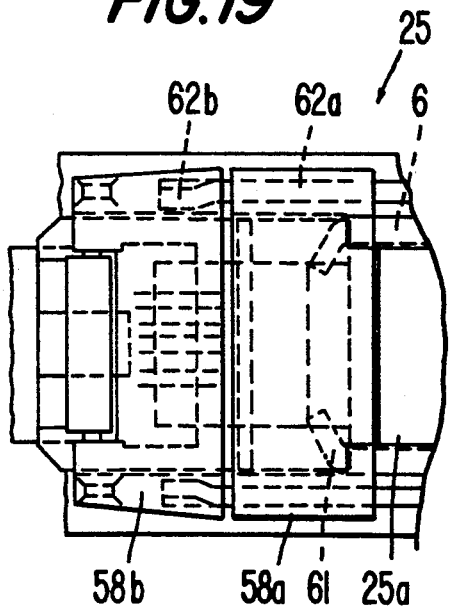
FIG. 19 is a detail in plan view of FIG. 18 without a ski boot.

According to FIGS. 18 and 19, the ski brake 25 has a base 25*a*, which is firmly connected to the heel holder 5, as well as a pedal 58, which bears at its free end a roller 59, the spindle 59*a* of which runs transversely to the longitudinal direction of the ski 2.

Between the toe-holding unit (not shown here) and the heel holder 5, the connecting element 3 is provided with an encasing 14 of plastic material, of which only a partial region is visible in FIG. 18.

As can be seen from FIGS. 18 and 19, the pedal 58 consists of a supporting member 58*a* and of an actuating flap 58*b*, which is displaceable perpendicularly to the resting plane of a ski boot 23. The supporting member 58*a* is articulated via a set-up spring 61 at the base 25*a* of the ski brake 25. In the supporting member 58*a* there are the bearing sections 62*a* of two brake spikes 62, the angled-off ends of which 62*b*, protruding from the supporting member 58*a*, are accommodated in recesses of the actuating flap 58*b*. The roller 59 is also mounted in the actuating flap 58*b*.

In the braking position of the ski brake 25, the two brake spikes 62 protrude with their brake spades 62*c* underneath the running surface of the ski 2, and the pedal 58 forms an acute angle $\alpha$ with the upper side of the ski 2 (see FIG. 1).

If the skier puts his ski boot 23 into the ski binding, the pedal 58 and the two brake spikes 62 are pivoted counterclockwise. This firstly causes the supporting member 58*a* to come into contact with the encasing 14. If the pressure on the actuating flap 58*b* is increased, the latter moves perpendicularly to the resting plane of the ski boot 23 relative to the supporting member 58*b* in the direction of the upper side of the ski 2. In the swung-down position of the ski brake 25, the actuating flap 58*a* is pressed down against the force of a further spring (not shown here), as a result of which the two brake spikes 62 are pivoted by means of their angled-off ends 62*b* toward the vertical longitudinal center plane of the ski 2, so that the two brake spikes 62 are within the profile of the ski with their brake spaces 62*c*. The diameter of the roller 59 mounted in the actuating flap 58*b* is dimensioned such that, with actuating flap 58*b* pressed down, the roller on the one hand rests on the encasing 14 or on the cover 16 and on the other hand is pressurized by the sole 23*a* of the ski boot 23 (see FIG. 18).

The use of such a ski brake 25 is particularly advantageous because the front part of the pedal 58, remote from the heel holder 5, is used for the transfer of pressure. Since the roller 59 is namely at a distance from the heel holder 5, any bending up of the ski 2 which is caused by the toe-holding unit 4 and the heel holder 5 when the ski boot 23 is clamped-in is counteracted with an increased counter-moment.

Figure 20:
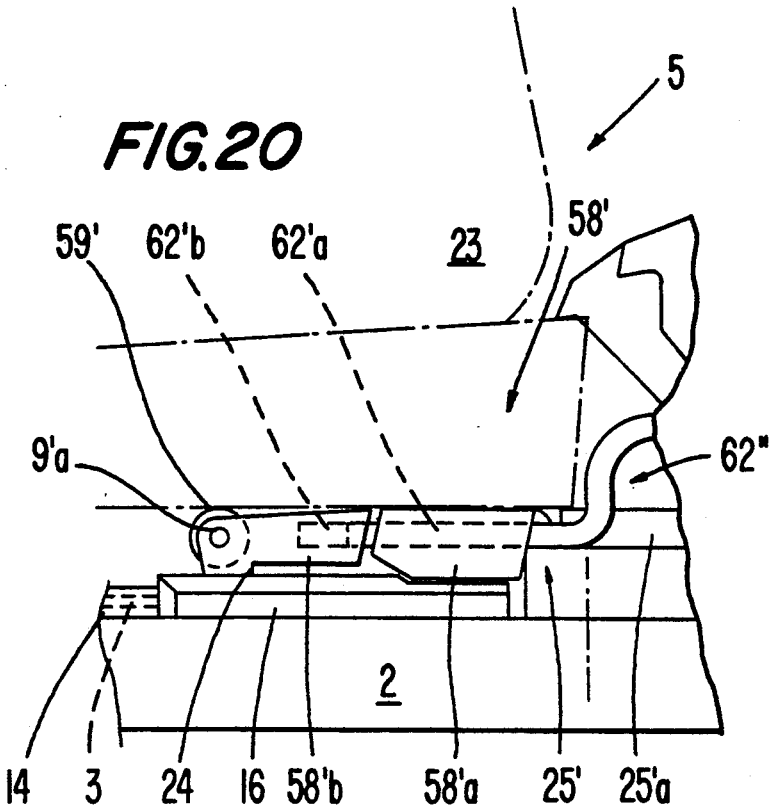
FIGS. 20 and 21 illustrate a further embodiment of the invention similar to FIGS. 18 and 19.
Figure 21:
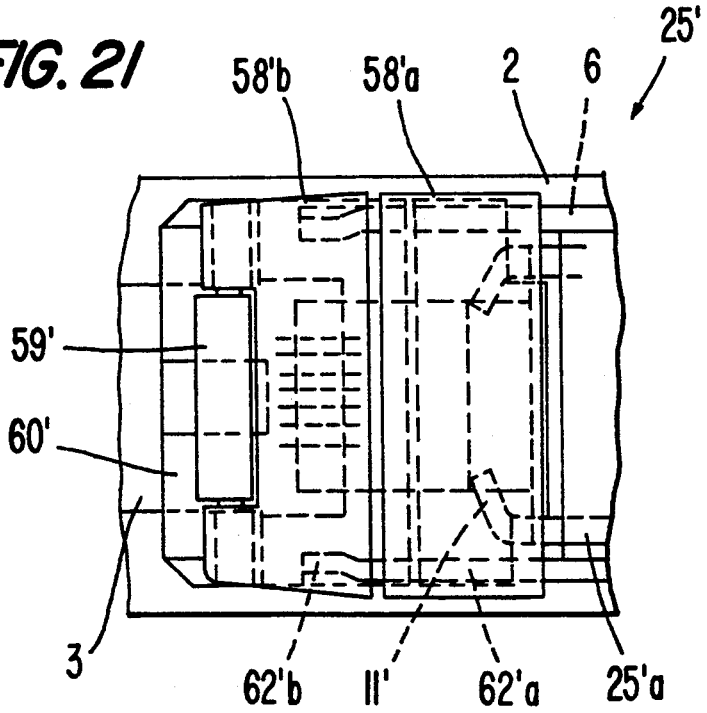

The embodiment of a ski binding shown in FIGS. 20 and 21 has a heel holder 5, which is coupled to the toe-holding unit (not shown) via a connecting element 3.

In contrast to the design according to FIGS. 18 and 19, the ski brake 25', the base 25'*a* of which is also connected here to the heel holder 5, does indeed have a roller 59'; nevertheless, with pedal 58' depressed, the said roller does not rest on the encasing 14 for the connecting element 3. Rather, in the running position, the support of the actuating flap 58'*b* against the encasing 14 or on the cover 16 is provided by means of two attachments 24, which protrude downward from the actuating flap 58'*b* and are arranged symmetrically with respect to the vertical longitudinal center plane of the ski brake 25'. In the running position, the ski boot 23 itself rests on the supporting member 58'*a* and on the roller 59' (cf. FIG. 20).

Figure 22:
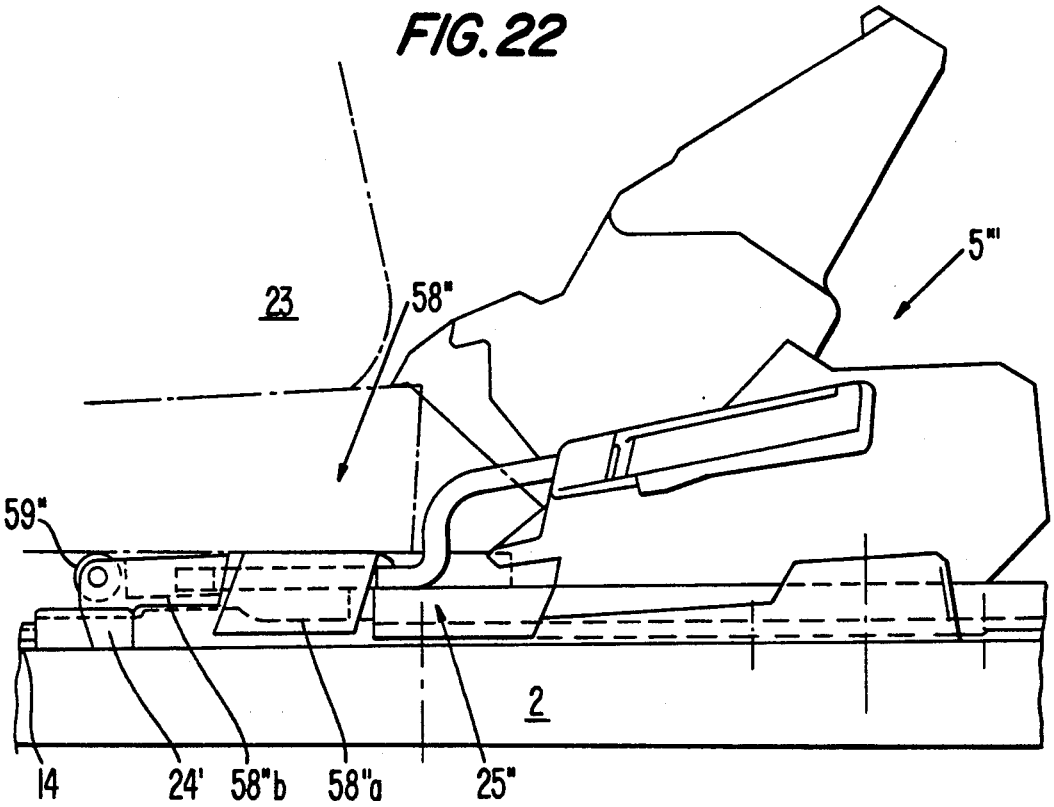
FIGS. 22 and 23 illustrate two further embodiments of the invention in side view and in the running position.

The ski brake 25'' according to FIG. 22 differs from the design just described in that the actuating flap 58'', which has a roller 59'' and two attachments 24', rests with these attachments 24' directly on the upper side of the ski 2, without an encasing 14 in between. This design brings with it the advantage that, when the pedal 58'' is depressed, due to the two attachments 24', a guidance for the actuating flap 58''*b* against the narrow side surfaces of the encasing 14 or of the cover 16 takes place. In the running position, the ski boot 23 again rests on the supporting member 58''*a* and on the roller 59''.

Figure 23:
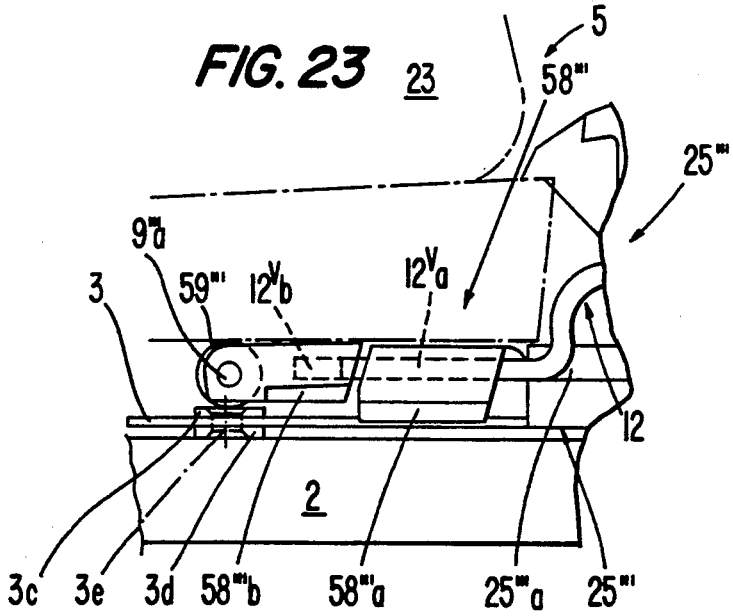

The design of a ski binding according to FIG. 23 is distinguished by the fact that, in the case of the ski brake 25''', the roller 59''' is supported on the upper side of the ski 2 via the connecting element 3. In this case, the connecting element 3 has in this region a rest 3*c* and 3*d*, respectively, both of its upper side and on its lower side.

These rests are firmly connected by means of rivets 3*e* to the connecting element 3.

Figure 24:
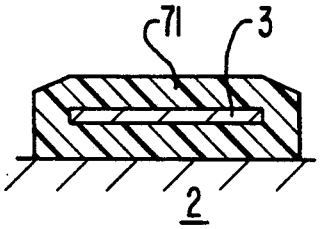
FIGS. 24 to 30 illustrate, on an enlarged scale, cross sections through various embodiments of the invention.

The embodiment of a connecting element 3 shown in FIG. 24 is distinguished by the fact that it is provided with an elastic layer 71 of foam rubber, foamed plastic or the like which is sprayed directly onto the connecting element 3. The elastic layer of FIG. 24 and the elastic portions of the other embodiments depicted in FIGS. 25–32 serve to absorb shock acting on a skier during a ski run.

Figure 25:
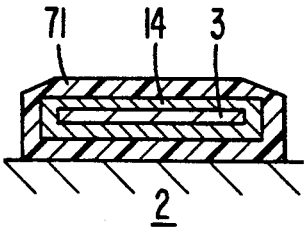

In contrast to this, in the case of the design according to FIG. 25, the connecting element 3 is provided with an encasing 14 of a plastic material, to which an elastic layer 71 is applied. Encasing 14 and elastic layer 71 have different moduli of elasticity.

Figure 26:
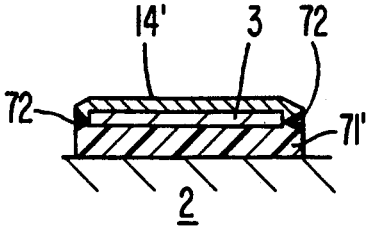

The embodiment according to FIG. 26 is distinguished by the fact that the connecting element 3—seen in cross section—is half surrounded by the encasing 14' of plastic material, whereas the other half is covered by an elastic layer 71'. The encasing 14' and the layer 71' are interconnected by two welds 72, which run in the longitudinal direction of the ski 2.

Figure 27:
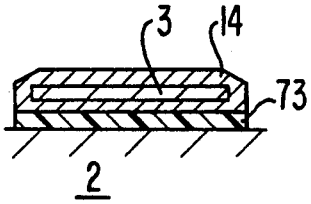

In the case of the design according to FIG. 27, the connecting element 3 is surrounded by an encasing 14 of plastic material. On the underside of this encasing 14, an elastic layer in the form of a thick film 73 is fastened, for example stuck on or vulcanized on.

Figure 28:
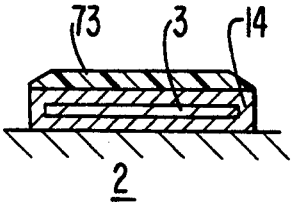

FIG. 28 shows the structural reverse of the embodiment just described. In this case, the connecting element 3 is again surrounded by an encasing 14 of plastic material. The film 73 is, however, stuck on the upper side of this encasing 14.

Figure 29:
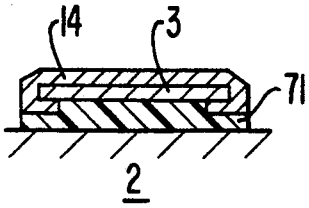

In the case of the design according to FIG. 29, the connecting element 3 is surrounded by an encasing 14 which—seen in cross section—covers the upper side of the connecting element 3, the two narrow side surfaces and the two border regions of the underside. Stuck onto this underside of the connecting element 3 is an elastic layer 71, which interconnects the two border regions of the encasing 14 resting on the underside of the connecting element 3.

Figure 30:
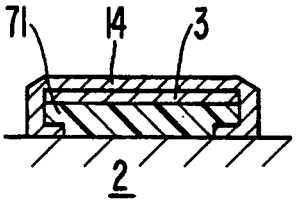

The exemplary embodiment according to FIG. 30 differs from this design solution in that, firstly, the elastic layer 71, which here is approximately T-shaped in cross section, is stuck onto the underside of the connecting element 3, after which the encasing 14 is fastened on the upper side and the two narrow side surfaces of the connecting element 3. In this case, the two end regions of the encasing 14 engage over the ends of the cross-sectional T-shaped elastic layer 71, each provided with a step.

In the case of the two following exemplary embodiments, the elastic layer 71 is arranged on the underside of the connecting element 3. It may, however, also be fastened on the upper side of the connecting element.

Figure 31:
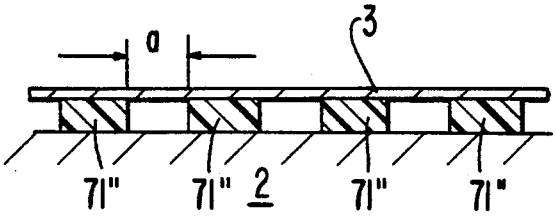
FIGS. 31 and 32 illustrate vertical longitudinal center sections on an enlarged scale, through two further embodiments of the invention.

According to the design as per FIG. 31, the elastic layer does not extend continuously over the entire length of the connecting element 3, but is subdivided into several sections 71'', which have regular intervals "a" from one another.

Figure 32:
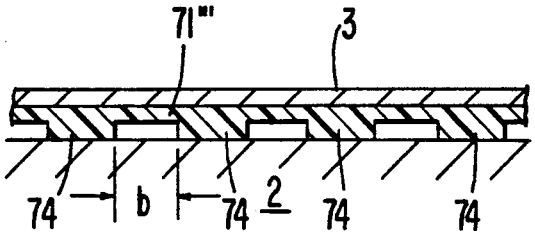

The design according to FIG. 32 does indeed have an elastic layer 71''' which is continuous in the longitudinal direction of the ski 2 and is stuck onto the underside of the connecting element 3; nevertheless, this layer has downwardly protruding, flat projections 74, which are at regular intervals "b" from one another.

Figure 33:
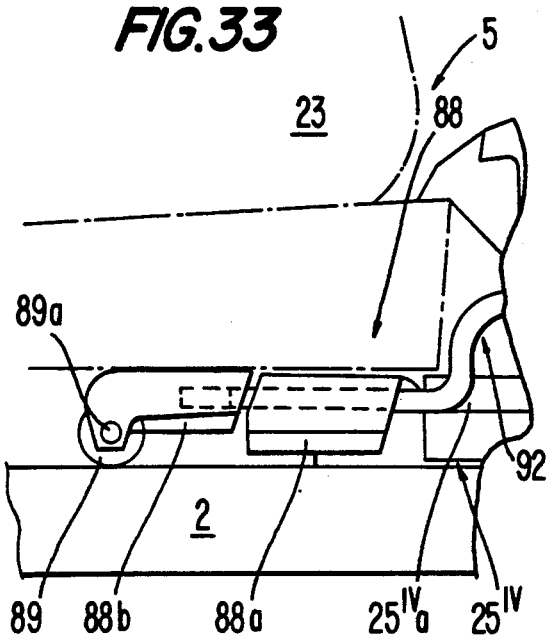
FIGS. 33 and 34 illustrate two side views of ski brakes according to a further development of the invention.

The embodiment of a ski binding shown in FIG. 33 is distinguished in particular by the fact that the toe-holding unit (not shown here) and the heel holder 5 are not interconnected via a connecting element and therefore are independent of each other.

The base 25$^{IV}$*a* of a ski brake 25*IV* is firmly connected to the heel holder 5. As in the case of the exemplary embodiment according to FIGS. 18 and 19, the ski brake 25$^{IV}$ has a pedal 88, which consists of a supporting member 88*a* and of an actuating flap 88*b*, the latter bearing a roller 89 at its free end. The arrangement and the function of the two brake spikes 92 correspond to those of the design according to FIGS. 18 and 19.

However, the spindle 89*a* of the roller 89 is arranged on the actuating flap 88*b* offset slightly downward in comparison with the said design. In the running position, the ski boot 23 therefore does not rest on the roller 89 but on the upper side of the actuating flap 88*b*. The contact pressure is transferred via the actuating flap 88*b* via the spindle 89*a* and via the roller 89 directly (without an encasing in between) to the upper side of the ski 2.

Figure 34:
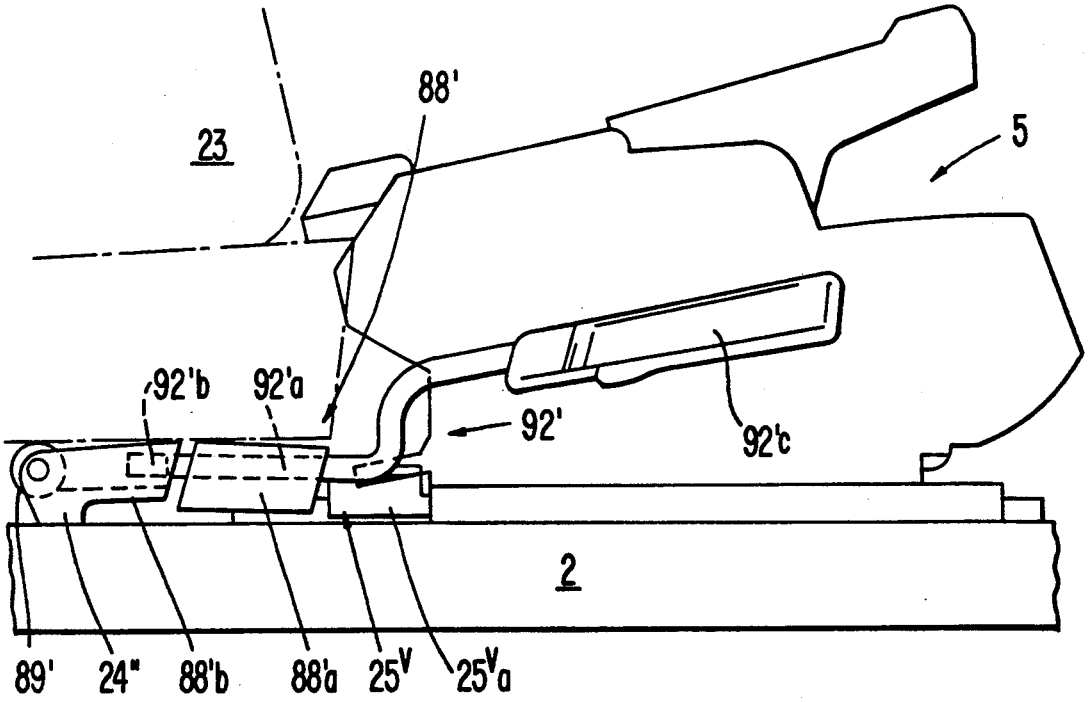

The embodiment of a ski binding according to FIG. 34 is similar to that shown in FIG. 33 in as much as, in the case of this ski binding as well, the toe-holding unit (not shown) and the heel holder 5 are fastened independently of each other on the upper side of the ski 2. Therefore, in the depressed state of the pedal 88', the actuating flap 88'*b* of the ski brake 25$^{V}$ rests on the upper side of the ski 2. Similarly to the preceding exemplary embodiment, in the running position, here too the ski boot 23 rests on the supporting member 88'*a* and on the roller 89' mounted in the actuating flap 88'*b*. In addition, the actuating flap 88'*b* has two attachments 24'', with which it rests directly on the upper side of the ski 2. The individual sections of the brake spikes 92' are denoted by 92'*a*, 92'*b* and 92'*c*.

The invention is not restricted to the exemplary embodiments shown in the drawing and described above. Rather, various modifications of the same are possible without departing from the scope of the invention. For example, any other locking means known per se can also be used for the locking of the connecting element on the guide rail.

Furthermore, the same connecting element can be used for the design according to FIGS. 14–17 with a toe-holding unit fixed to the ski and with an adjustable toe-holding unit, which brings with it advantages in production. In this case, the connecting element according to FIGS. 14 and 15 or according to FIG. 15*a* can also be used in conjunction with a toe-holding unit or with a guide rail for a toe-holding unit in which the continuation is designed as a cylindrical pin, since, as already mentioned, the side walls of the square hole touch the circumference of each cylindrical hole. The same applies in the case of a shaping of the projection with a polygonal or unround cross section. In this way, the range of application of the connecting element according to the invention is further increased.

We claim:

1. A ski binding, comprising:

a guide rail;

a toe holding unit;

a heel holding unit movable along the guide rail;

a connecting element including at least one receptacle, said connecting element extending between and connecting said toe holding unit and said heel holding unit;

a plastic encasing surrounding and affixed to at least a portion of the connecting element; and means for varying a connection location of the toe holding unit and the connecting element to adjust a distance between the toe holding unit and the heel holding unit, the varying means for permitting the distance to be adjusted while maintaining an interconnection between the toe holding unit and a ski.

2. A ski binding according to claim 1, wherein the connecting element includes a series of holes disposed in an end region thereof proximate the toe holding unit, and the locking element includes a bolt for engaging one of said holes in said connecting element.

3. A ski binding according to claim 1, wherein the bolt is pivotally mounted in the toe holding unit guide rail and includes an elongated head, said holes in said connecting element each having an elongated shape corresponding to the elongated head of the bolt, said bolt being rotatable for preventing the head thereof from passing through an opening in the connecting element in which the bolt is inserted.

4. A ski binding according to claim 3, wherein the toe holding unit guide rail includes a base portion having feet disposed thereon for maintaining a space between said guide rail and an upper surface of the ski, a portion of said connecting element being disposed in the space.

5. A ski binding according to claim 1, wherein the toe holding unit guide rail includes screw openings disposed therein, said screw openings for receiving fastening screws for exerting a force on the connecting element to urge the connecting element against an upper side of the ski.

6. A ski binding according to claim 1, wherein said at least one receptacle of said connecting element includes a row of openings disposed in the connecting element, one of said openings having an unround cross-section and the remaining openings having a circular cross-section, a width of the unround opening being greater than a diameter of a circular opening.

7. A ski binding according to claim 1, wherein said at least one receptacle includes a series of openings disposed in said connecting element, two of said openings having an unround cross-section, and the remaining openings having a circular cross-section.

8. A ski binding according to claim 7, wherein at least one opening with a circular cross-section is arranged between two unround openings.

9. A ski binding according to claim 7, wherein an unround opening has a square cross-section, a projection of sides of the square forming tangents to the openings of circular cross-section.

10. A ski binding according to claim 6, wherein an unround opening has a square cross-section, a projection of sides of the square forming tangents to the openings of circular cross-section.

11. A ski binding according to claim 1, further including a ski brake having a pedal element disposed thereon, said pedal element for transferring pressure from a ski boot onto a ski.

12. A ski binding according to claim 11, wherein the pedal element includes a roller.

13. A ski binding according to claim 11, wherein the pedal element includes two attachments, arranged symmetrically with respect to a vertical longitudinal center plane of the ski binding, and protrudes towards a ski on which the binding is mounted.

14. A ski binding according to claim 12, wherein the connecting element is encased in a plastic material, and the roller transfers pressure from a skier via the encased connecting element to a ski.

15. A ski binding according to claim 13, wherein the connecting element is encased in a plastic material, and the attachments transfer pressure from a skier via the connecting element to a ski.

16. A ski binding according claim 1, wherein the connecting element includes an elastic layer.

17. A ski binding according to claim 1, wherein the connecting element includes a metal portion and an elastic portion, the elastic portion being disposed on an underside of the metal portion.

18. A ski binding according to claim 1, wherein the connecting element includes both a plastic encasing and an elastic layer.

19. A ski binding according to claim 1, wherein the connecting element includes an encasing, the encasing at least partially including an elastic layer disposed on an underside of the connecting element.

20. A ski binding according to claim 18, wherein the plastic encasing surrounds the elastic layer, the elastic layer and plastic encasing having different moduli of elasticity.

21. A ski binding according to claim 19, including two welds for joining the plastic encasing and the elastic layer.

22. A ski binding according to claim 16, wherein the elastic layer is adhered to an underside of the connecting element.

23. A ski binding according to claim 18, wherein the elastic layer is adhered to an underside of the plastic encasing.

24. A ski binding according to claim 16, wherein the connecting element includes a rigid layer, and the elastic layer includes of a series of sections which are disposed at intervals on an underside of the rigid layer.

25. A ski binding according to claim 16, wherein the connecting element includes a rigid layer, and the elastic layer is disposed on an underside of the rigid layer, the elastic layer having a series of projections spaced from each other at intervals, the projections for supporting the connecting element on an upper side of a ski.

26. A ski binding according to claim 18, wherein the connecting element includes a rigid layer, and the plastic encasing engages an underside of the rigid element, the elastic layer being disposed on an underside of the plastic encasing.

27. A ski binding according to claim 18, wherein the connecting element includes a rigid layer, and the plastic encasing engages an underside of the rigid layer, the elastic layer being disposed on the rigid layer between two portions of the encasing.

28. A ski binding, comprising:

a toe holding unit;

a tread plate for placement adjacent the toe holding unit;

a heel holding unit mountable on a ski for selective movement along a longitudinal axis of the ski;

a cover plate for placement adjacent the heel holding unit;

a connecting element for interconnecting the toe holding and the heel holding unit, the tread plate and the cover plate for covering portions of the connecting element adjacent the toe holding unit and the heel holding unit, respectively;

a plastic encasing affixed to and surrounding at least a portion of the connecting element; and means for varying a connection location of the toe holding unit and the connecting element to adjust a distance between the toe holding unit and the heel holding unit, the varying means for permitting the distance to be adjusted while maintaining an interconnection between the toe holding unit and a ski.

29. A ski binding as set forth in claim 28 wherein the varying means includes a protrusion extending from the toe holding unit and a plurality of receptacles located in the connecting element.

30. A ski binding as set forth in claim 28 wherein at least one of the tread plate and the cover plate are slidable along the connecting element.

31. A ski binding as set forth in claim 28 wherein the connecting element includes a metal band and the plastic encasing surrounds and conforms to a shape of at least a portion of the band.

32. A ski binding, comprising:

first and second guide rails mountable on a ski;

a toe holding unit movable along the first guide rail;

a tread plate for placement adjacent the toe holding unit;

a heel holding unit movable along the second guide rail;

a cover plate for placement adjacent the heel holding unit;

a connecting element for interconnecting the toe holding and the heel holding unit, the tread plate and the cover plate for covering portions of the connecting element adjacent the toe holding unit and the heel holding unit, respectively;

a plastic encasing affixed to and surrounding at least a portion of the connecting element; and means for varying a connection location of the toe holding unit and the connecting element to adjust a distance between the toe holding unit and the heel holding unit, the varying means including a locking element connected to the first guide rail and at least one receptacle located in the connecting element.

33. A ski binding as set forth in claim 32, wherein the varying means includes means for permitting the distance to be adjusted while maintaining an interconnection between the toe holding unit and a ski.

34. A ski binding as set forth in claim 32 wherein the connecting element includes a metal band, the metal band being at least partially embedded in the plastic encasing.

35. A ski binding, comprising:

a toe holding unit guide rail having a locking element;

a toe holding unit movable on said toe holding unit guide rail;

a heel holding unit, said heel holding unit being movable along a heel holding unit guide rail; and a connecting element having a row of openings disposed therein, one of the openings having an unround cross-section and the remaining openings having a circular cross-section, a width of the unround opening being greater than the diameter of the circular opening, said connecting element extending between said toe holding unit and said heel holding unit, said locking element being selectively engageable with said at least one receptacle, and said heel holding unit being movable relative to the connecting element and being connectable to the connecting element to adjust the distance between the heel holding unit and the toe holding unit.

36. A ski binding, comprising:

a toe holding unit guide rail having a locking element;

a toe holding unit movable on said toe holding unit guide rail;

a heel holding unit, said heel holding unit being movable along a heel holding unit guide rail; and a connecting element including a series of openings disposed therein, two of the openings having an unround cross-section, and the remaining openings having a circular cross-section, said connecting element extending between said toe holding unit and said heel holding unit, said locking element being selectively engageable with said at least one receptacle, and said heel holding unit being movable relative to the connecting element and being connectable to the connecting element to adjust the distance between the heel holding unit and the toe holding unit.

* * * * *